US007332880B2

(12) United States Patent
Ina et al.

(10) Patent No.: US 7,332,880 B2
(45) Date of Patent: Feb. 19, 2008

(54) PARTICLE BEAM ACCELERATOR

(75) Inventors: Nobuhiko Ina, Tokyo (JP); Yuichi Yamamoto, Tokyo (JP); Takahisa Nagayama, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 161 days.

(21) Appl. No.: 11/374,182

(22) Filed: Mar. 14, 2006

(65) Prior Publication Data

US 2006/0250097 A1 Nov. 9, 2006

(30) Foreign Application Priority Data

Mar. 15, 2005 (JP) ..... 2005-073368

(51) Int. Cl.
*H05H 7/00* (2006.01)

(52) U.S. Cl. ..... 315/501; 250/396 R

(58) Field of Classification Search ..... 315/500, 315/501; 250/396 R
See application file for complete search history.

(56) References Cited

U.S. PATENT DOCUMENTS 2,748,339 A * 5/1956 Rudenberg ..... 310/305
5,051,600 A * 9/1991 Schuetz et al. ..... 250/492.3
6,433,494 B1 * 8/2002 Kulish et al. ..... 315/500

OTHER PUBLICATIONS

D. W. Kerst, et al., Electron Model of a Spiral Sector Accelerator, The Review of Scientific Instruments, Oct. 1960, pp. 1076-1106. vol. 31, No. 10.

* cited by examiner

*Primary Examiner*—Thuy Vinh Tran
(74) *Attorney, Agent, or Firm*—Buchanan Ingersoll & Rooney PC

(57) ABSTRACT

The present invention provides a particle beam accelerator for accelerating charged particles along a traveling direction of the charged particles. The invention provides a particle beam accelerator, in which the charged particle beam deflected by spiral-shaped-deflecting electromagnet 3, is accelerated by an accelerating unit 5, the charged particle beam circulating in an annular vacuum passageway of a vacuum duct 1 a plurality of times differing in orbit. And gap 9 is formed in the accelerating unit 5 of the vacuum duct 1, and gap-constituting face of the vacuum duct 1 is formed to be perpendicular to each of the traveling directions of the charged particle beam orbiting on a first orbit and on a second orbit. In the above accelerator, vibrations of the charged particle beam can be brought under control and loss of the charged particle beam can be reduced.

19 Claims, 7 Drawing Sheets

PARTICLE BEAM ACCELERATOR

BACKGROUND OF THE INVENTION

1. Field of the Invention

The present invention is related to a particle beam accelerator for generating a high-energy charged particle beam.

2. Description of the Related Art

Particle beam accelerators are devices for accelerating particles by applying energy to the particles, and a high-energy charged particle beam extracted from the particle beam accelerators has recently been used in various fields such as radiation treatment, including not only research but also medical fields.

The particle beam accelerators are categorized into linear accelerators and annular passageway accelerators. The former are linear accelerators for accelerating particles in a linearly disposed electric acceleration field, whereas, the latter are accelerators having an annular passageway through which particles pass, and particles are accelerated by accelerating units that are disposed along the passageway, while they are orbiting in the annular passageway. In the latter case, because particles are accelerated every time they orbit in the passageway, the accelerators can provide charged particles with higher energy than that by the linear accelerators, and can generate a high-energy charged particle beam. Therefore, recently, the latter accelerators are widely used for generating the high-energy charged particle beam.

In an accelerator having the annular passageway as described above, an RF or betatron system is used as the acceleration system thereof, and the accelerator has, as a shape thereof, a structure in which circular arc deflecting electromagnets are fitted to a linear vacuum duct, or spiral-shaped-deflecting electromagnets are fitted to a circular arc vacuum duct.

Although there is a problem in that the size of the particle beam accelerator having a linear vacuum duct becomes bulky, it has an advantage in that the accelerating units can easily be formed, because the accelerating units can be disposed at portions of the linear vacuum duct.

On the other hand, because the size of the particle beam accelerator to which the spiral-shaped-deflecting electromagnets are fitted, can be reduced, thereby an installation area for the accelerator can be reduced, and consequently, manufacturing cost of the accelerator can be further brought under control.

The conventional accelerator as described above, to which the spiral-shaped-deflecting electromagnets are fitted, is structured in such a way that gaps are formed in the accelerating units, and, the vacuum duct is sealed by covering the gaps with ceramic materials as an insulating material. However, ceramic materials can not be easily formed in any curve, which has entailed the shape of the gaps being adjusted to that of the ceramic materials. In other words, the gap-constituting faces of the vacuum duct are formed flat.

On the other hand, in the free space between the deflecting electromagnets, that is, in the space between the deflecting electromagnets on the annular passageway in which the charged particle beam in the vacuum duct passes through, circumferential angles at the start and end of the free space, on the outer circumference and inner circumference, are different from each other. In other words, the charged particle beam on an orbit in the outer circumference is not parallel with the charged particle beam on an orbit in the inner circumference, and both beams have slightly become out of parallel with each other.

As described above, although the charged particle beam on an orbit in the outer circumference is not parallel with the charged particle beam on an orbit in the inner circumference in the conventional accelerator to which the spiral-shaped-deflecting electromagnets are fitted, and both beams become slightly out of parallel with each other, the end faces of the vacuum duct that compose the gap, have been flat. Therefore, the charged particle beam has been accelerated to not only a traveling direction but also a lateral direction by acceleration voltage. In other words, there have been problems in that the acceleration voltage can not be applied to the orbiting charged particle beam in parallel with the beam, which causes the beam to undergo an acceleration force in a direction other than the traveling direction, and to vibrate, resulting in a beam loss.

SUMMARY OF THE INVENTION

An objective of the present invention is to provide a particle beam accelerator for accelerating a charged particle along a traveling direction of the charged particle.

The present invention provides a particle beam accelerator, in which the charged particle beam, whose orbit is deflected by a spiral-shaped-deflecting electromagnet, is accelerated by an accelerating unit, the charged particle beam circulating in an annular passageway of a vacuum duct a plurality of times differing in orbit. And gap is formed in the accelerating unit of the vacuum duct, and an end face of the vacuum duct, which composes the gap, is formed to be perpendicular to each of the traveling directions of the charged particle beam orbiting on a first orbit and on a second orbit.

In the particle beam accelerator as described above, vibrations of the charged particle beam can be brought under control, which are generated due to a force applied to the beam in a direction other than its traveling direction, and loss of the charged particle beam can be reduced accordingly, because gap is formed in the accelerating unit of the vacuum duct, and the gap-constituting face of the vacuum duct is formed to be perpendicular both to the traveling direction of the charged particle beam while circulating in a first orbit, and to the traveling direction of the charged particle beam while circulating in a second orbit.

DETAILED DESCRIPTION OF THE PREFERRED EMBODIMENTS

Hereinafter, Embodiments of the invention are explained according to diagrams.

Embodiment 1

Figure 1:
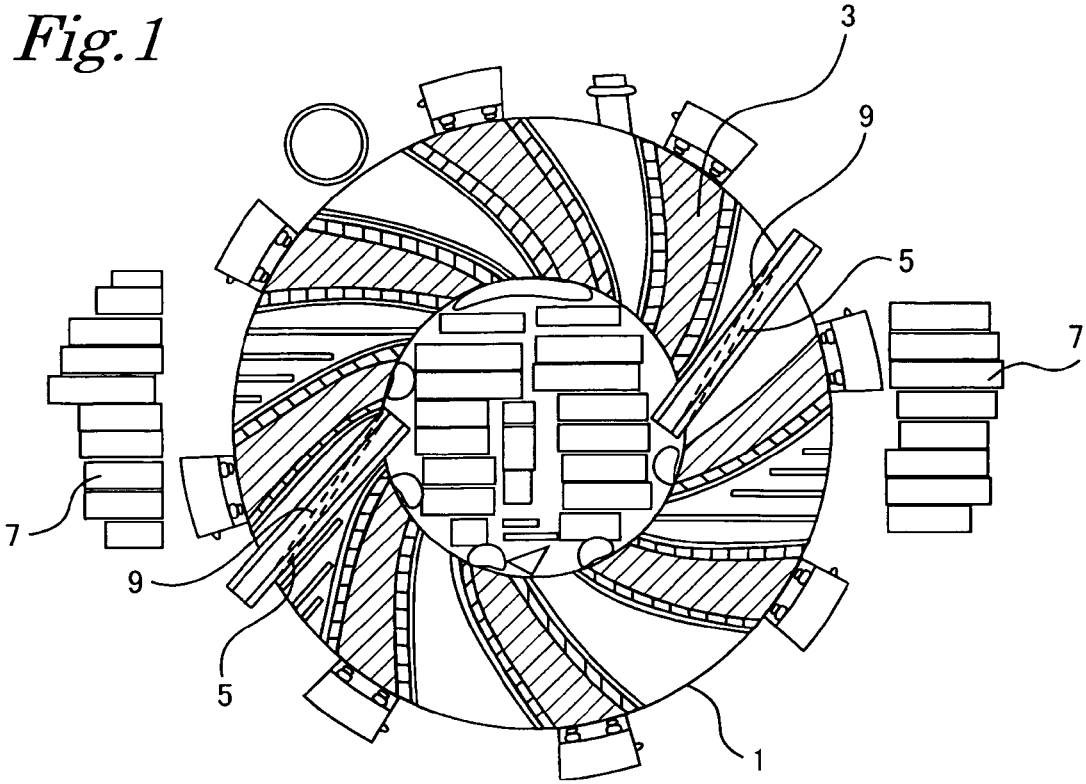
FIG. 1 is an entire arrangement of a particle beam accelerator for explaining Embodiment 1 of the invention.

FIG. 1 is a top view illustrating a configuration of a particle beam accelerator according to Embodiment 1.

As illustrated in FIG. 1, the particle beam accelerator according to Embodiment 1 mainly comprises an annular vacuum duct "1", a plurality of spiral-shaped-deflecting electromagnets "3", accelerating units "5", and accelerating cores "7".

The vacuum duct 1 is composed by piecing stainless sheets together in an annular shape, and includes, inside the duct, sealed space having a rectangular cross-section. The sealed space is maintained in vacuum state at the time of use, and used as an annular vacuum passageway for passing a charged particle beam. As described above, the annular passageway for passing the charged particle beam is formed inside the annular vacuum duct 1, and the accelerating units 5 for accelerating the charged particle beam are disposed in the vacuum duct 1.

In the vacuum duct 1, a plurality of spiral-shaped-deflecting electromagnets 3, for example eight electromagnets, are disposed circumferentially along the vacuum duct 1 at predefined equi-intervals. The electromagnets 3 are used for leading the charged particle beam, which passes in the vacuum duct 1, to predefined orbits.

Moreover, the accelerating units 5 are circumferentially disposed at, for example, two positions in the vacuum duct 1, and accelerating gaps "9" are formed in the accelerating units 5. In other words, the tubular vacuum duct 1 is intermissive at the accelerating unit 5, so that the end face of one vacuum duct 1 and the end face of the other vacuum duct 1 are disposed facing each other. Thereby, the gap is formed in the space between the vacuum ducts 1. The accelerating gaps 9 are not sealed by the vacuum duct 1. Therefore, inductive voltage is intensively generated across the gaps 9 at the time of generating the inductive voltage.

Here, the end faces of the vacuum duct 1, which constitute the gap 9, are not a simple plane, but are formed in a curve. The gap 9 formed at the accelerator 5 is structured in detail such that the end faces of the vacuum duct 1, which constitute the accelerating gap 9, are formed to be perpendicular to the traveling directions of the charged particle beam. In other words, because the charged particle beam orbits a plurality of times on different orbits along the annular vacuum passageway, the traveling direction of the charged particle beam slightly differs each time and therefore the end faces are formed to be perpendicular to the traveling directions of the charged particle beam on each orbit.

For example, the end face is formed to be perpendicular to the traveling direction of the charged particle at the point where the particle passes through on a first orbit, and to the traveling direction of the charged particle at the point where the particle passes through on a second orbit. In the same way, the end face is also formed to be perpendicular to the following traveling directions of the charged particle beam.

Moreover, the accelerating cores 7 for accelerating the charged particle beam are disposed at the accelerating units 5 so as to surround the vacuum duct 1 and the accelerating gaps 9. In FIG. 1, a pair of accelerating cores 7 is disposed symmetrically with respect to the center of the vacuum duct 1. Then, the magnetic field at the gaps 9 is intensified by exciting betatron cores as the accelerating cores 7, thereby, the inductive voltage is generated in parallel with the traveling directions of the charged particle beam in the vacuum duct 1.

Figure 2:
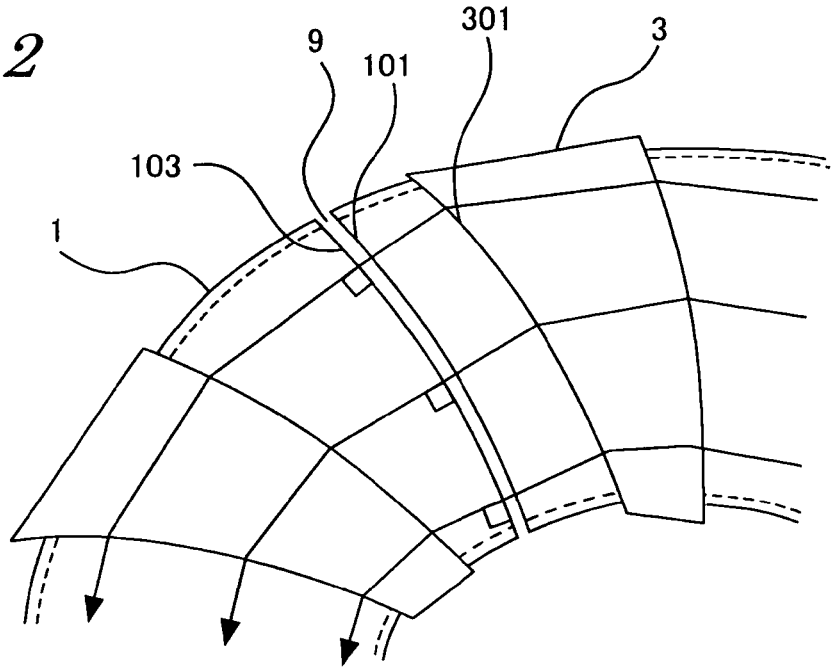
FIG. 2 is a schematic diagram illustrating a spiral-shaped-deflecting electromagnet and an accelerating gap illustrated in FIG. 1.

FIG. 2 is a schematic diagram illustrating spiral-shaped-deflecting electromagnets 3 and accelerating gap 9 illustrated in FIG. 1. In FIG. 2 arrows illustrate the traveling directions of the charged particle beam at each of the orbits. As illustrated in FIG. 2, an end face "301" of the deflecting electromagnet 3 is not plane but has a curvature in the accelerator in which the spiral-shaped-deflecting electromagnet 3 has been adopted. Therefore, inner side and outer side orbits of the charged particle beam deflected by the deflecting electromagnet 3 are not parallel with each other in the vacuum duct 1.

Therefore, in order to provide acceleration electric field that is always parallel to the beam orbits in the accelerating gap 9, the accelerating gap in which end faces "101" and "103" of the vacuum duct 1 have a curvature, is required as illustrated in FIG. 2. In the accelerator according to Embodiment 1, an acceleration electric field that is always parallel to the beam orbits in the accelerating gap 9, can be provided by forming the end faces 101 and 103 in a curve.

Figure 3:
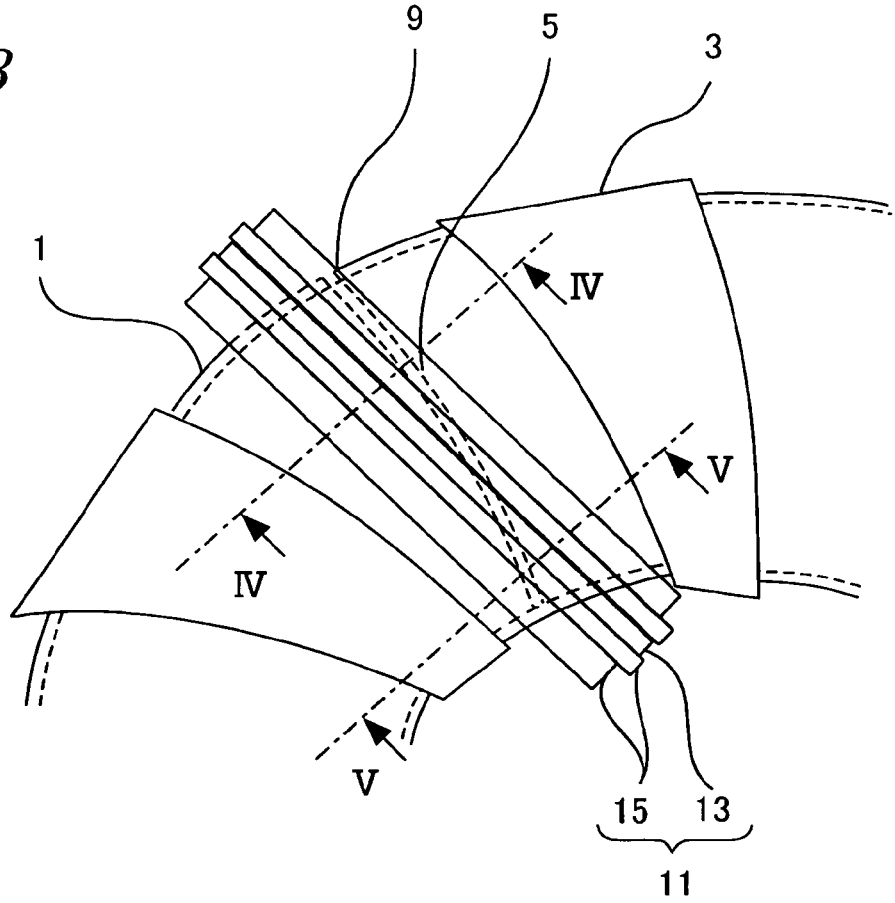
FIG. 3 is a diagram illustrating a relevant portion of a proximity of an accelerating unit illustrated in FIG. 1.
Figure 4:
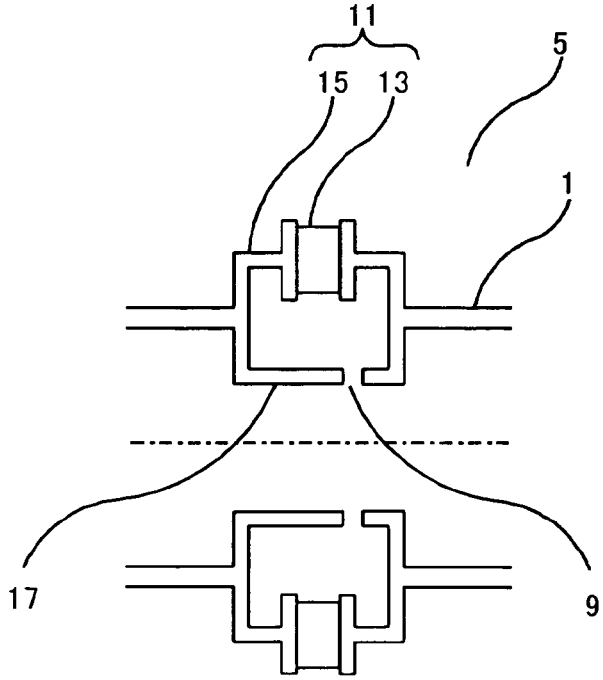
FIG. 4 is a cross-sectional view along the line "IV-IV" of the particle beam accelerator illustrated in FIG. 3.
Figure 5:
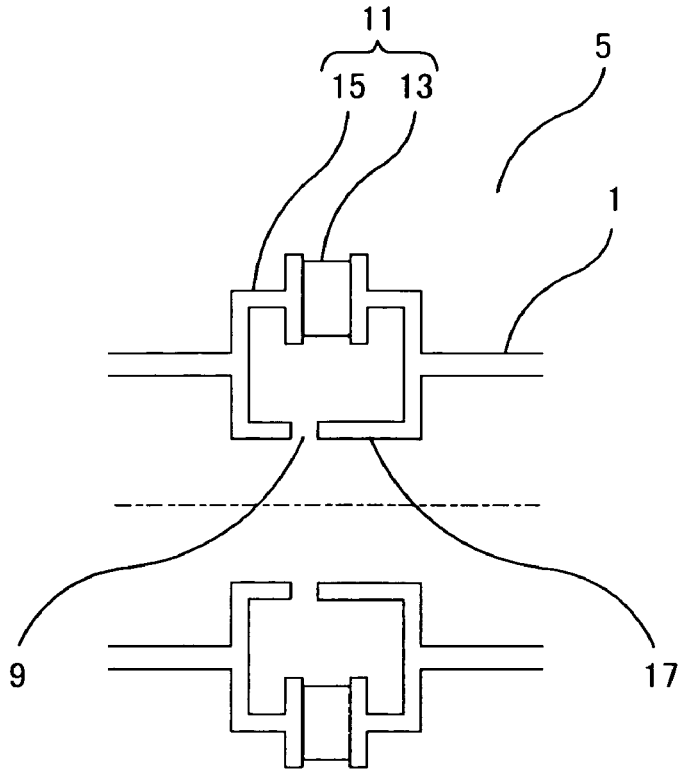
FIG. 5 is a cross-sectional view along the line "V-V" of the particle beam accelerator illustrated in FIG. 3.

FIG. 3 is a diagram illustrating a relevant portion in the periphery of an accelerating unit 5 illustrated in FIG. 1. FIG. 4 and FIG. 5 are cross-sectional views along lines "IV-IV" and "V-V" of the particle beam accelerator illustrated in FIG. 3. As illustrated in FIG. 3, an accelerating gap 9 having curved faces that are perpendicular to the beam orbits, is formed in the accelerating unit 5 in order to generate an acceleration electric field that is parallel to the beam orbits in the gap 9. Therefore, the gap must be covered and sealed in order to vacuate the passageway in which the charged particle is passed.

In the accelerator illustrated in FIG. 1, in order to seal the accelerating unit 5, a disc shaped sealing member "11" whose central portion is a cavity, is formed to cover the gap 9 in the vacuum duct 1, in which the accelerating gap 9 is formed as illustrated in FIG. 4 and FIG. 5. The sealing member 11 may be composed of, for example, an insulating member, or may be composed of a nonmagnetic metal such as a stainless member, and an insulating member being combined. As the insulating member, hard members, such as ceramic members, may be used. Here, it is preferable that the ceramic members are combined with other members that can be easily formed in practical use, because the ceramic members can not be easily formed due to their brittleness (hard and brittle property).

In FIG. 3 through FIG. 5, the sealing member 11 is composed of a ceramic member "13" and a connection member "15" for connecting the ceramic member 13 to the vacuum duct 1. Nonmagnetic metals, such as stainless steel members, may be used as the connection member 15.

Moreover, in order to connect the sealing member 11 to the vacuum duct 1, the connection member 15, which outwardly juts with respect to a portion on which the accelerating gap 9 is formed, may be formed as sealing portion on the vacuum duct 1 as illustrated in FIG. 4 and FIG. 5, and the ceramic member 13 as the sealing member 11 may be connected to the sealing portion.

Furthermore, the accelerating gap 9 is formed on the inward face "17" that inwardly juts with respect to the main face of the vacuum duct 1, as illustrated in FIG. 4 and FIG. 5.

Figure 6:
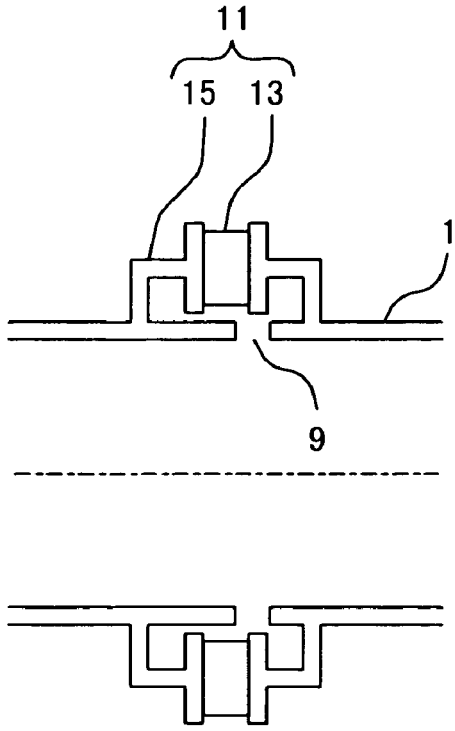
FIG. 6 is a diagram illustrating a configuration of another accelerating unit according to Embodiment 1 of the invention.
Figure 7:
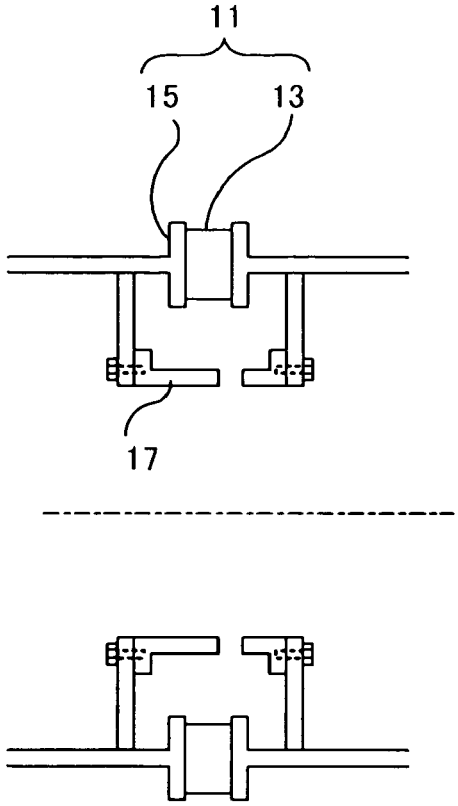
FIG. 7 is a diagram illustrating a configuration of another accelerating unit according to Embodiment 1 of the invention.

Although the accelerating gap 9 is formed on the inward face 17 with respect to the main face of the vacuum duct 1 in the particle beam accelerator illustrated in FIG. 3 through FIG. 5, the accelerating gap 9 may be formed on the main face of the vacuum duct 1 as illustrated in FIG. 6. Moreover, the face 17, on which accelerating gap 9 is formed, may be manufactured as a separate piece from the main face of the vacuum duct 1, and the inward face 17 may be connected, with screws and the like, onto a portion that inwardly juts with respect to the main face of the vacuum duct 1, as illustrated in FIG. 7.

Next, operations will be explained.

A charged particle beam that has entered the accelerator illustrated in FIG. 1 (or, a charged particle beam generated in the accelerator) is deflected by the spiral-shaped-deflecting electromagnets 3 disposed on the annular vacuum passageway in order to change the orbit to an appropriate direction, and is accelerated by the accelerating unit 5 disposed between the spiral-shaped-deflecting electromagnets 3 in accordance with orbiting in the vacuum duct 1 a plurality of times. Thereby, the charged particle beam continues to orbit in the annular vacuum passageway a plurality of times on a different orbit from the immediately processing orbit each time.

At this time, in the accelerating units 5, very strong alternating electric power is supplied to the accelerating cores 7, thereby magnetic flux in the accelerating cores 7 is varied, so that accelerating electric field, which is parallel to the beam orbits, is generated, in the accelerating gap 9, according to the electromagnetic induction law. Because end faces of the vacuum duct 1, which constitute the gap 9, are formed perpendicular to each of traveling directions of the charged particle beam on each orbit, the end faces constituting the gap 9 are always formed perpendicular to each of traveling directions of the charged particle beam orbiting on a first orbit and a second orbit, and therefore the acceleration electric field is supplied to the gap 9 in such a way that the charged particle beam is always accelerated to the traveling directions. Thereby, beam vibrations generated due to acceleration force applied in directions other than the traveling directions of the beam, can be controlled, so that beam losses can be reduced.

Embodiment 2

In Embodiment 1, the particle beam accelerator has a two-fold structure in which the accelerating gap is formed in a curve, and the accelerating gap is sealed by a disc insulating member made of a ceramic material and having plane main faces. In a particle beam accelerator according to Embodiment 2, however, a vacuum duct includes flanges sandwiching a resin material, so that the gap is formed between the flanges linked together via the resin material intervening. Here, other configurations are the same as those of the particle beam accelerator according to Embodiment 1.

Figure 8:
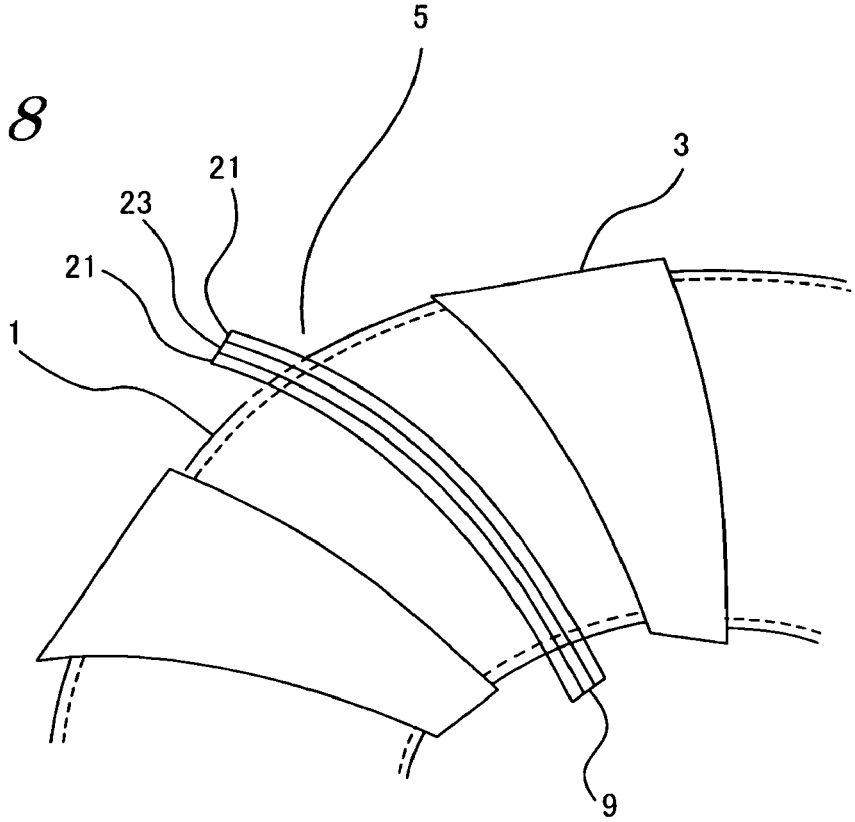
FIG. 8 is a diagram for explaining an accelerating gap in a particle beam accelerator according to Embodiment 2 of the invention.
Figure 9:
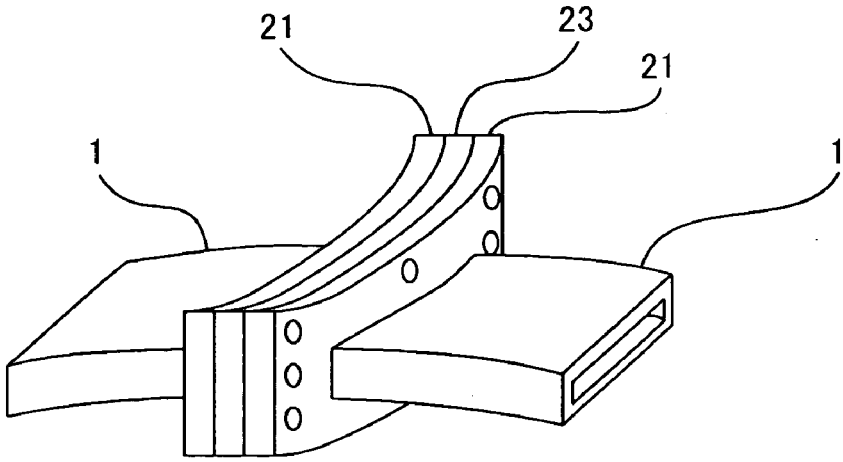
FIG. 9 is a schematic diagram illustrating a proximity of a sealing member illustrated in FIG. 8.

FIG. 8 is a diagram for explaining the accelerating gap in the particle beam accelerator according to Embodiment 2. FIG. 9 is a schematic diagram illustrating periphery of the sealing member illustrated in FIG. 8. As illustrated in FIG. 8 and FIG. 9, flanges "21" are formed on the vacuum duct 1, and a resin material "23" is sandwiched between the flanges 21. As a result, a gap is formed between the flanges 21 connected to each other via the resin material 23, and thereby the accelerating gap 9 is formed.

Figure 10:
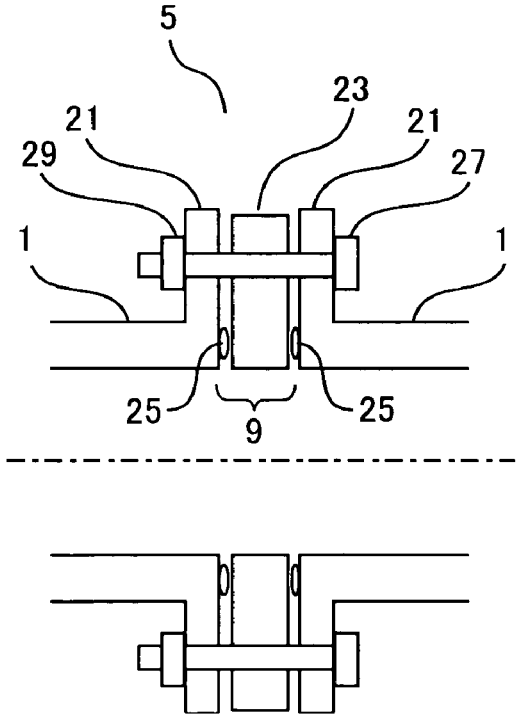
FIG. 10 is a diagram illustrating another aspect according to Embodiment 2 of the invention.

FIG. 10 is a diagram illustrating another aspect according to Embodiment 2, and the diagram is a cross-sectional view illustrating periphery of the accelerating gap of the particle beam accelerator. The resin material 23 is sandwiched between the flanges 21 via O-rings "25" as illustrated in FIG. 10, instead of directly sandwiching the resin material 23 between the flanges 21 as illustrated in FIG. 9, when the resin has been sandwiched between the flanges.

In order to form the accelerating gap 9 in which an air gap is formed in a curve as illustrated in FIG. 10, the resin material 23, such as polyimide resin material, may be sandwiched via O-rings 25 between the flanges 21 cutting the vacuum duct 1 and having curved faces formed in an orientation perpendicularly to the beam passing orbits, and the flanges may be screwed with an insulating bolt "27" and an insulating nut "29", so that the resin material 23 is deformed.

By composing the accelerator as illustrated in FIG. 8, FIG. 9, or FIG. 10 instead of using an expensive ceramic member made of formed ceramic, a curved gap perpendicular to the beam passing orbits, can be formed, so that the accelerator cost can be reduced.

Embodiment 3

In Embodiment 2, the accelerating gap is formed by sandwiching the resin material 23 between the flanges 21, which have curved faces perpendicular to the beam passing orbits, via O-rings 25. In a particle beam accelerator according to Embodiment 3, however, protrusions are provided on the resin material, and the resin material is fixed to the flanges via the protrusions. Here, other configurations are the same as those of the particle beam accelerator according to Embodiment 1.

Figure 11:
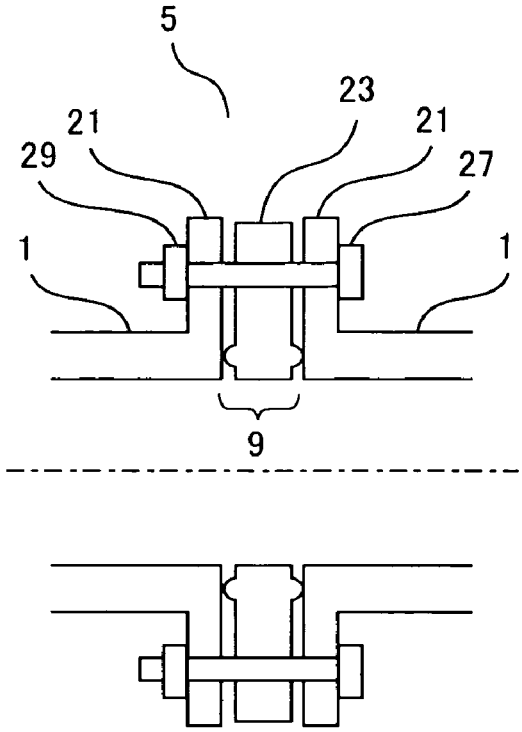
FIG. 11 is a diagram for explaining an accelerating gap in a particle beam accelerator according to Embodiment 3 of the invention.

FIG. 11 is a diagram for explaining an accelerating gap in a particle beam accelerator according to Embodiment 3. The flanges 21 are formed on the vacuum duct 1 as illustrated in FIG. 7, and the resin material 23 having protrusions is sandwiched between the flanges 21.

In order to form the accelerating gap 9 as illustrated in FIG. 11, the resin material 23, such as polyimide resin material, having the protrusions, may be sandwiched between the flanges 21 cutting the vacuum duct 1 and having curved faces formed in an orientation perpendicularly to the beam passing orbits, and the flanges may be screwed with the insulating bolt 27 and the insulating nut 29, so that the resin material 23 is deformed.

By composing the accelerator as illustrated in FIG. 11, the O-rings cab be omitted in addition to the effects in Embodiment 2, so that the accelerator cost can be further reduced.

Embodiment 4

In Embodiment 3, the accelerating gap 9 is formed by sandwiching the resin material 23, on which the protrusions are provided, between the flanges 21. In a particle beam accelerator according to Embodiment 4, however, protrusions are provided on the flanges, and the resin member is fixed to the flanges via the protrusions. Here, other configurations are the same as those of the particle beam accelerator according to Embodiment 1.

Figure 12:
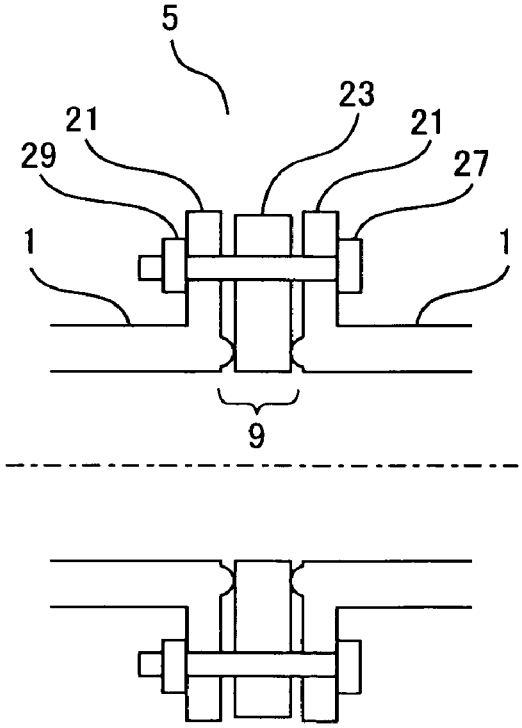
FIG. 12 is a diagram for explaining an accelerating gap in a particle beam accelerator according to Embodiment 4 of the invention.

FIG. 12 is a diagram for explaining an accelerating gap in a particle beam accelerator according to Embodiment 4. The flanges 21 having protrusions are formed on the vacuum duct 1 as illustrated in FIG. 12, and the resin material 23 is sandwiched between the flanges 21.

In order to form the accelerating gap 9 as illustrated in FIG. 12, the protrusions are formed on the flanges 21 cutting the vacuum duct 1 and having curved faces formed in an orientation perpendicularly to the beam passing orbits, and the resin material 23, such as polyimide resin material, may be sandwiched between the flanges 21, and furthermore flanges may be screwed with the insulating bolt 27 and the insulating nut 29 so that the resin material 23 is deformed.

Although positional deviation of a vacuum seal has easily occurred in the structure of the accelerating units of the particle beam accelerator according to Embodiment 3, and thereby the reliability of vacuum-tightness has been low, in the accelerating units structured as illustrated in FIG. 12, the reliability of vacuum-tightness can be increased compared to the particle beam accelerator according to Embodiment 3.

Embodiment 5

In a particle beam accelerator according to Embodiment 5, the resin material is composed by laminating a plurality of resin sheets. Here, other configurations are the same as those of the particle beam accelerator according to Embodiment 2 through Embodiment 4.

Figure 13:
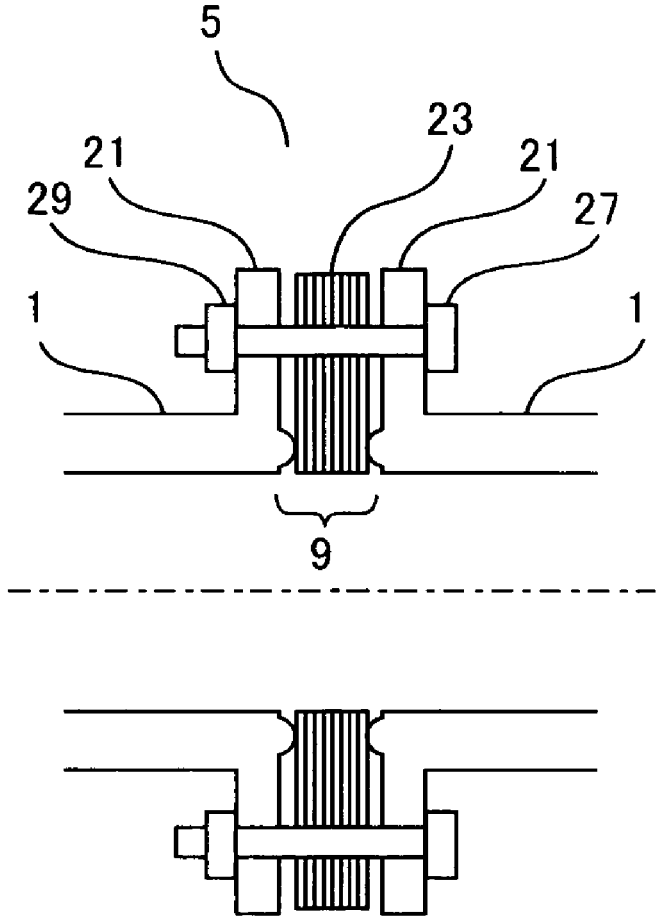
FIG. 13 is a diagram for explaining an accelerating gap in a particle beam accelerator according to Embodiment 5 of the invention.

FIG. 13 is a diagram for explaining an accelerating gap in the particle beam accelerator according to Embodiment 5. The resin material 23 is composed by laminating a plurality of resin sheets as illustrated in FIG. 13. In addition, in order to form the accelerating gap 9, the protrusions are formed on the flanges 21 cutting the vacuum duct 1 and having curved faces formed in an orientation perpendicularly to the beam passing orbits, and the resin material 23 composed by laminating a plurality of resin sheets, such as polyimide resin, may be sandwiched between the flanges 21, and furthermore flanges may be screwed with the insulating bolt 27 and the insulating nut 29 so that the resin material 23 is deformed.

Although an structural example is illustrated, in which the resin material 23 illustrated in FIG. 12 is composed by laminating a plurality of resin sheets, the resin material may be composed by laminating a plurality of resin sheets in other structures.

In the configurations as illustrated in Embodiment 2 through Embodiment 4, a thick resin material is needed, if the accelerating gaps having a large air gap is required. Therefore, in order to deform the resin material so as to fit the flange shape, and to screw the flanges at a level of allowing the vacuum seal, flanges must be made thick, and expensive flanges must be used accordingly. In contrast, in the configurations in which the resin material 23 is composed by laminating a plurality of resin sheets as illustrated in FIG. 13, screwing force can be decreased. Thereby, the thickness of the flanges can be decreased, and the flanges can be manufactured in cheaper cost than the flanges in Embodiment 2 through Embodiment 4. Here, the O-rings or the flanges having protrusions have been adopted in these Embodiments; however, although the reliability of vacuum-tightness is not so good as those of above Embodiments, similar effects can be obtained without forming protrusions thereon.

Although the Embodiments of the present invention are explained by referring the diagrams, the specific configuration is not limited to these Embodiments, but other configurations are included in the present invention as long as the spirit and scope of the present invention is maintained.

What is claimed is:

1. A particle beam accelerator comprising:

an annular vacuum duct having an annular passageway inside for passing a charged particle beam, and including an accelerating unit for accelerating the charged particle beam;

a plurality of spiral-shaped-deflecting electromagnets disposed circumferentially along the vacuum duct; and an accelerating core, disposed on the accelerating unit, for accelerating the charged particle beam; wherein the charged particle beam, whose orbit is deflected by the spiral-shaped-deflecting electromagnet, is accelerated by the accelerating unit, the accelerating charged particle beam circulating in the annular vacuum passageway a plurality of times differing in orbit;

a gap is formed in the accelerating unit of the vacuum duct; and the gap-constituting face of the vacuum duct is formed to be perpendicular both to the traveling direction of the charged particle beam while circulating in a first orbit, and to the traveling direction of the charged particle beam while circulating in a second orbit.

2. The particle beam accelerator according to claim 1, wherein the gap-constituting face of the vacuum duct is formed in a curve.

3. The particle beam accelerator according to claim 1, further comprising a sealing member for sealing the gap.

4. The particle beam accelerator according to claim 3, wherein the sealing member is provided on a portion of the vacuum duct jutting outwardly with respect to the portion where the gap is formed.

5. The particle beam accelerator according to claim 3, wherein the sealing member includes at least a hard insulating member.

6. The particle beam accelerator according to claim 3, wherein the vacuum duct includes a gap forming portion, inwardly jutting with respect to its main portion, and the gap is formed in the gap forming portion.

7. The particle beam accelerator according to claim 1, wherein the vacuum duct includes flanges sandwiching a resin material, and the gap is formed between the flanges linked together with the resin material intervening.

8. The particle beam accelerator according to claim 7, wherein the resin material is sandwiched between the flanges via O-ring.

9. The particle beam accelerator according to claim 7, wherein protrusions are provided on the resin material or on the flanges, and the resin material is attached to the flanges through the protrusions.

10. The particle beam accelerator according to claim 7, wherein the resin material is composed by laminating a plurality of resin sheets.

11. A particle beam accelerator comprising:

an annular vacuum duct having an annular passageway inside for passing a charged particle beam, and including an accelerating unit for accelerating the charged particle beam;

a plurality of spiral-shaped-deflecting electromagnets disposed circumferentially along the vacuum duct; and an accelerating core, disposed on the accelerating unit, for accelerating the charged particle beam; wherein a gap is formed in the accelerating unit of the vacuum duct; and the gap-constituting face of the vacuum duct is formed in a curve.

12. The particle beam accelerator according to claim 11, further comprising a sealing member for sealing the gap.

13. The particle beam accelerator according to claim 12, wherein the sealing member is provided on a portion of the vacuum duct jutting outwardly with respect to the portion where the gap is formed.

14. The particle beam accelerator according to claim 12, wherein the sealing member includes at least a hard insulating member.

15. The particle beam accelerator according to claim 12, wherein the vacuum duct includes a gap forming portion, inwardly jutting with respect to its main portion, and the gap is formed in the gap forming portion.

16. The particle beam accelerator according to claim 11, wherein the vacuum duct includes flanges sandwiching a resin material, and the gap is formed between the flanges linked together with the resin material intervening.

17. The particle beam accelerator according to claim 16, wherein the resin material is sandwiched between the flanges via O-ring.

18. The particle beam accelerator according to claim 16, wherein protrusions are provided on the resin material or on the flanges, and the resin material is attached to the flanges through the protrusions.

19. The particle beam accelerator according to claim 16, wherein the resin material is composed by laminating a plurality of resin sheets.

* * * * *